United States Patent [19]

Jonnet

[11] 4,131,070

[45] Dec. 26, 1978

[54] COKE QUENCHING CAR

[75] Inventor: Albert G. Jonnet, Oakdale, Pa.

[73] Assignee: Koppers Company, Inc., Pittsburgh, Pa.

[21] Appl. No.: 811,685

[22] Filed: Jun. 30, 1977

[51] Int. Cl.[2] ..... B60D 9/02

[52] U.S. Cl. ..... 105/273; 105/274; 214/64

[58] Field of Search ..... 214/64; 298/11, 13, 298/17 R, 17.7, 18; 105/270–275, 260

[56] References Cited

U.S. PATENT DOCUMENTS

| | | | |
|---|---|---|---|
| 1,881,203 | 10/1932 | Ludowici | 105/273 |
| 3,101,974 | 8/1963 | Robertson et al. | 105/271 X |
| 3,583,335 | 6/1971 | Schilf et al. | 105/272 X |

FOREIGN PATENT DOCUMENTS

| | | | |
|---|---|---|---|
| 578572 | 6/1933 | Fed. Rep. of Germany | 105/273 |
| 36594 | 6/1968 | German Democratic Rep. | 105/273 |

*Primary Examiner*—Albert J. Makay
*Attorney, Agent, or Firm*—R. Lawrence Sahr

[57] ABSTRACT

A coke quenching car is disclosed wherein the hopper is pivotally mounted to a superstructure continuation of the car frame, at points on both ends of the hopper adjacent to its top side which faces the coke side of a coke oven. A means for pivoting the top of the hopper upwards and towards the coke side of the coke oven is included. A discharge gate is attached to the bottom side of the hopper running the length of the hopper and hinged to the lower edge of the hopper side which faces the coke side of the coke oven. As the car is spotted at the coke wharf, the means for lifting pivots the hopper upward, aligning the discharge gate with the coke wharf; the gate is then swung downward to form a chute to the coke wharf. The contents of the hopper descend the inclined plane thus emptying the coke quench car.

6 Claims, 3 Drawing Figures

COKE QUENCHING CAR

BACKGROUND OF THE INVENTION

1. Field of the Invention

This invention relates to coke oven quench cars that are used to receive coke as it is ejected from the coke side of a coke oven battery, then used to transport that coke, through a means of quenching, to a coke wharf where the coke is deposited for further processing and use.

2. Description of the Prior Art

In known coke quenching cars, the hopper is large in volume, capable of handling up to twenty tons of coke. The hopper of such a car is pivotally mounted to the car frame, the points of pivotation being on both ends adjacent to the bottom corner, remote from the coke side of a coke oven. This corner is formed by the bottom and one side of the hopper. Thus the bottom corner generally defines the axis of pivotation. A means for pivoting the hopper about this axis operates to raise the hopper, the bottom of the hopper forming an inclined plane in the raised position.

A gate is pivotally mounted, by a hinge, to the side of the hopper. The gate forms the lower half of the hopper side when the hopper is not raised and is in its normal position. In the raised position, the gate is pivoted downward onto the coke wharf allowing the coke to descend the inclined plane, formed by the side of the hopper, onto the wharf. Once the car is emptied, the gate is closed and the hopper is lowered to its normal position.

Because of the positioning of the pivotation axis in relation to the pivotation arc, the bottom of the hopper must be positioned, in its normal lowered position, at an elevation higher than the elevation of the coke wharf to enable emptying of the coke onto the wharf. Thus the capacity of the hopper is limited. There is a need for a means of unloading coke quench cars which allows the hopper bottom to be at a lower elevation, thus enabling increase in the volumetric capacity of the hopper.

Another problem is that pivotation of the hopper significantly transfers the center of gravity of the load substantially off of the center of the car frame, creating a tendency to tilt the coke quench car. This tendency is overcome, in practice, by widening the car frame and its wheel base as well as the tracks upon which it rides. Thus more valuable space is required, as well as more expensive equipment, that would be if the system were not subject to a significant transfer of the center of gravity of the load. There is a need for a means of unloading a coke quench car which does not significantly transfer the center of gravity of the load.

SUMMARY OF THE INVENTION

The present invention is directed primarily to improvements in coke quench cars in which the hopper is pivoted at its upper end corners, being those corners which are adjacent to the car side nearest the coke side of the coke oven. Hereinafter this side of the hopper will be referred to as the "coke side." A superstructure is mounted on the car frame. Pivot points are located on the superstructure adjacent to the two end corners of the hopper. Trunnions are interposed between the superstructure pivot points and the hopper pivot points. Means of raising the hopper are pivotally fixed, at their bottoms, to the car frame and, at their tops, to the hopper, at points on either end of the hopper, adjacent to the hopper side which is opposite the coke side of the coke oven. Hereinafter this side of the hopper will be referred to as the "opposite side." The hopper is raised, pivoting about its pivot points, as the bottom of the hopper is directed upward from the horizontal towards the vertical. At the point, where the coke side of the hopper becomes positioned coextensive to the inclined plane of the coke wharf, the motion of the hopper stops. A discharge gate is hinged to the hopper bottom, the hinge being positioned at the corner formed by the hopper bottom and the hopper coke side. This gate forms approximately half of the hopper floor when closed. In the hopper's raised position, the discharge gate is opened, swinging downward onto the coke wharf to form a chute leading from the hopper to the coke wharf, allowing the coke to discharge from the hopper on an inclined plane.

Accordingly, one of the principal features of the present invention is to provide a hopper which pivots into discharge position without significantly transferring the center of gravity of the load within the hopper. Thus a larger load can be handled by the coke quench car without fear of tipping the car over. Also, less width is needed for the car frame, the wheel base and the tracks upon which the car wheels ride.

Another feature of this invention is that, due to the fact that the whole hopper bottom is raised, in the pivotation motion, to an elevation above the wharf, the floor of the car can be lowered, below the level of that wharf, providing greater capacity within the hopper.

These and other features of the present invention will be more completely disclosed and described in the following specification, the accompanying drawings and the appended claims.

DETAILED DESCRIPTION

Figure 1:
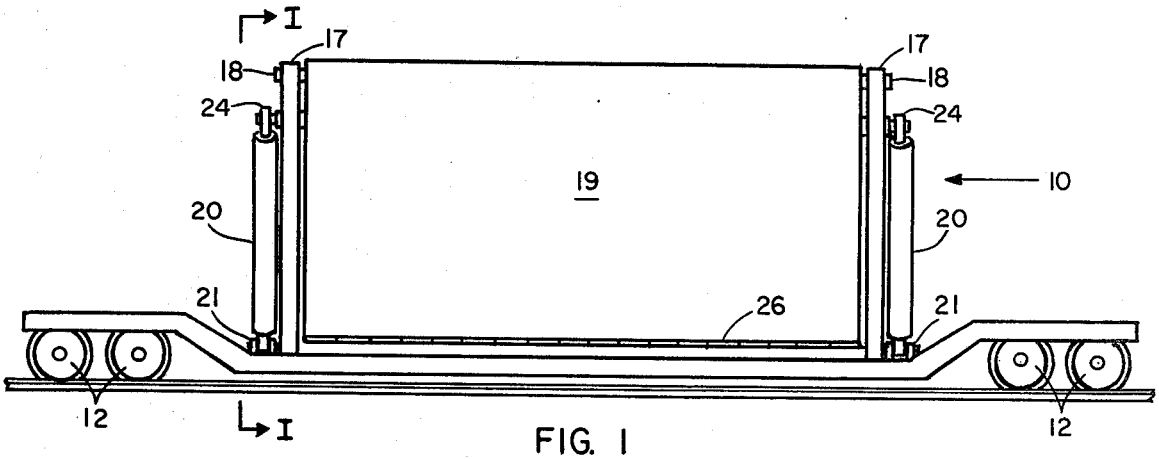
FIG. 1 is a view of the coke quenching car as seen from the coke side of the coke oven, thus it is denominated hereinafter as the coke side of the coke quenching car.
Figure 2:
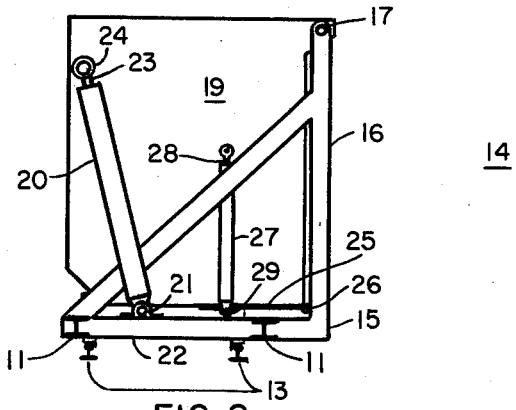
FIG. 2 is a sectional end view of the coke quenching car viewed from point I-I depicted in FIG. 1. The hopper is in the lowered or normal position.

Referring to the drawings, there is illustrated a coke quenching car generally designated by the numeral 10 that includes a frame 11 movable supported on wheels 12. The wheels are mounted on rails 13 that extend longitudinally along the coke side of a coke oven battery generally designated by the numeral 14 as illustrated in FIG. 2. A superstructure 15 is mounted on the frame 11. The superstructure 15 contains, as an integral part, two vertical uprights 16 positioned on the side of the car 10 nearest to the coke side of the coke oven battery 14, as illustrated in FIG. 2. Each of the uprights 16 contain, at its uppermost point, a pivotation point 17 in the form of a bearing. The pivotation points 17 are in line forming a single axis, coextensive with the upper edge of the coke side of the coke quenching car 10. A trunnion 18 is contained by each pivotation point 17 and fixed, at its end, to a hopper 19 at the extreme upper corners of its ends, adjacent to the coke side of the hopper 19. A pair of lift cylinders 20 are pivotally fixed, at their bases 21, to horizontal elements 22 of the superstructure 15. The lift cylinders 20 are typical double acting hydraulic cylinders of combined capacity sufficient to safely lift the hopper 19 with a full load of coke. The lift cylinders 21 have extensible members 23 operated by hydraulic pressure. Eyes 24 fixed to the extreme ends of the extensible members 23 are pivotally connected to the hopper 19, proximate to the top of the hopper 15 along the side edge of the hopper 15 proximate to the opposite side of the hopper. A gate 25 is attached, by a hinge 26, to the bottom of the hopper 19, the hinge 26 running the length of the bottom edge of the coke side of the hopper 19. The gate 25 forms a portion of the bottom of the hopper 19. A pair of gate cylinders 27 are pivotally fixed, by their rods 28, to the ends of the hopper 19, the gate cylinder bases 29 being pivotally mounted onto the edges of the gate 25.

Figure 3:
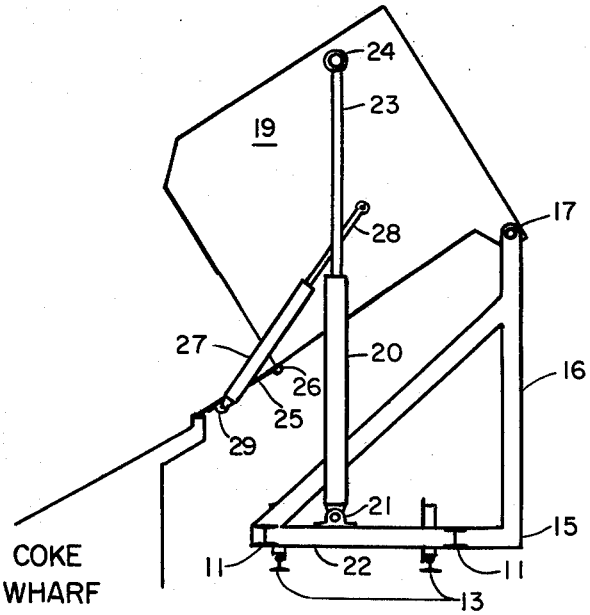
FIG. 3 is a sectional end view of the coke quenching car viewed from point I—I depicted in FIG. 1. The hopper is in the raised or discharge position, with the gate opened onto a schematic representation of the coke wharf.

After the coke quenching car 10 is filled with hot coke, it is moved through a quenching station, where the coke is cooled, to a coke wharf where the coke is to be unloaded. Prior to unloading, the position of the hopper 19, in relation to the coke quench car 10, is as illustrated in FIG. 2. Hydraulic pressure is introduced into the lift cylinders 20, causing the extensible members 23 to extend. This forces the eyes 24, pivotally connected to the hopper 19, to move upwards, thus raising the hopper 19. The hopper 19 pivots upwards about its pivotation points 17 coming to rest in the position illustrated in FIG. 3. At this point hydraulic pressure is released, at a controlled rate, from the gate cylinders 27, allowing their rods 28 to extend, thus the gate 25 opens downward, pivoting about the hinge 26. The coke is released, through an aperture port in the bottom of the hopper 19, uncovered by the open gate 25, onto the coke wharf. Hydraulic pressure is re-introduced to the gate cylinders 27, retracting the rods 28, thus closing the gate 25. Pressure is released, at a controlled rate, from the lift cylinders 20 allowing the hopper 19 to return to the position illustrated in FIG. 2 and the coke quench car 10 returns to the coke ovens for another load of coke.

According to the provisions of the patent statutes, the principle, preferred construction and mode of operation of the present invention have been explained and its best embodiment has been illustrated and described. However, it is to be understood that, within the scope of the appended claims, the present invention may be practiced otherwise than as specifically illustrated and described.

What is claimed is:

1. A coke quenching car comprising:

(a) a horizontal frame assembly of oblong shape;

(b) a plurality of wheels mounted to said frame and positioned to suspend said frame;

(c) a superstructure rigidly fixed to said frame;

(d) an oblong hopper, pivotally mounted to the upper extremity of said superstructure at pivot points adjacent to the top coke side corner of said hopper, the bottom of said hopper containing a port aperture extending the length of and approximately half of the width of said hopper;

(e) means to pivotally elevate said hopper about said pivot point;

(f) a gate pivotally mounted to the bottom of said hopper, positioned to cover said port aperture in said hopper at one end of the pivotation arc of said gate;

(g) a plurality of hydraulic gate cylinders, the base of each being pivotally mounted to an end edge of said gate, positioned to allow said gate to pivot away from said hopper, thus uncovering said port aperture; and (h) a plurality of rods, one each of which is extensibly mounted within each said gate cylinder so as to extend and retract within said gate cylinder in the conventional manner, the exposed end of each being pivotally mounted to one end of said hopper at a point whereon extension of said rod from said gate cylinder produces a pivotation of said gate away from said bottom of said hopper.

2. A coke quenching car as recited in claim 1, in which said hopper comprises:

(a) a front side opposite to the coke side of the coke oven battery in conjunction with which said coke quenching car is used;

(b) a rear side adjacent to said coke side of said coke oven battery and running parallel to said front side;

(c) a pair of ends connecting the ends of said front side to the ends of said rear side, parallel to each other and at 90° angles to said front side and said rear side;

(d) a floor connected at its edges to the bottom edge of said front side, extending one-half the distance to said rear side, along the bottom edges of said ends perpendicular to said front side.

3. A coke quenching car as recited in claim 1 in which said means to pivotally elevate said hopper about said pivot point comprises:

(a) a plurality of hydraulic lift cylinders of conventional design, pivotally mounted, at their bases to said superstructure, positioned at the ends of said hopper;

(b) a plurality of extensible members, one each for each said lift cylinder, mounted within said lift cylinders in a conventional manner, pisitioned to extend and retract in conformity with the operation of said lift cylinder;

(c) a plurality of eyes, one each fixed to the exposed end of each said extensible member, pivotally mounted to the top front side corner of said hopper.

4. A coke quenching car as recited in claim 1, in which said superstructure comprises:

(a) a plurality of horizontal elements rigidly fixed to said frame perpendicular to the longitudinal axis of said frame, positioned outboard from the ends of said hopper;

(b) a plurality of vertical uprights, one each of which is fixed at its base to each said horizontal element, extending substantially to the height of said hopper, positioned on said coke side of said coke quenching car;

(c) a plurality of pivotation bearings, one each of which is fixed to the uppermost end of each vertical upright, all said pivotation bearings being aligned along a single axis passing through said pivot points of said hopper;

(d) a plurality of trunnions, one each rotatably mounted within each said pivotation bearing, one end of each fixed to each said pivotation point of said hopper.

5. A coke quenching car as recited in claim 1, further comprising a plurality of hinges the fulcrums of which are aligned along a single axis adjacent to the bottom edge of said coke side of said hopper, fixed to said bottom edge of said coke side of said hopper and the coke side edge of said gate, such as to enable said gate to be pivoted about said fulcrums.

6. A coke quenching car comprising:

(a) a horizontal frame assembly of oblong shape;

(b) a plurality of wheels mounted to said frame and positioned to suspend said frame;

(c) a plurality of horizontal elements rigidly fixed to said frame perpendicular to the longitudinal axis of said frame, positioned equidistant from the longitudinal midpoint of said frame proximate to the ends of said frame;

(d) a plurality of vertical uprights, one each of which is fixed at its base to each said horizontal element, positioned on the coke side of said coke quenching car;

(e) a plurality of pivotation bearings, one each of which is fixed to the uppermost end of each vertical upright, all said pivotation bearings being aligned along a single axis;

(f) a plurality of trunnions, one each rotatably mounted within each said pivotation bearing;

(g) a hopper of general oblong cubicle shape, the sides of which are rectangular, the ends of which are approximate squares, having an open top, the bottom of said hopper containing a port aperture extending the length of and approximately half of the width of said hopper, the balance of said bottom being a floor connected at its edges to said ends and one of said sides of said hopper, the longitudinal midpoint of said hopper being positioned longitudinally on said midpoint of said frame and between said horizontal elements, the ends of said trunnions fixed at their ends to the upper coke side corners of said ends of said hopper, said port aperture being positioned, on said bottom of said hopper, adjacent to said coke side of said hopper, said floor being positioned adjacent to the front side of said hopper;

(h) a plurality of hydraulic lift cylinders of conventional design, pivotally mounted at their bases to said horizontal elements, positioned at the ends of said hopper;

(i) a plurality of extensible members, one each for each said lift cylinder, mounted within said lift cylinders in conventional manner, positioned to extend and contract in conformity with the operation of said lift cylinder;

(j) a plurality of eyes, one each fixed to the exposed end of each said extensible member, pivotally mounted to the top front side corner of said hopper;

(k) a plurality of hinges the pivotal fulcrums of which are aligned along a single axis adjacent to the bottom edge of said coke side of said hopper, a first leg of each hinge being fixed to said bottom edge of said coke side of said hopper;

(l) a gate, one side edge of which is fixed to each second leg of each said hinges, of sufficient size to cover said port aperture of said bottom of said hopper, being disposed to cover said port aperture at one end of the pivotal arc of said hinge and to form a chute from said port aperture at the other end of said pivotal arc of said hinge;

(m) a plurality of hydraulic gate cylinders, the base of each being pivotally mounted to an end edge of said gate, positioned to allow said gate to pivot, about said axis of said fulcrums of said hinges, away from said hopper, thus uncovering said port aperture;

(n) a plurality of rods, one each of which is extensibly mounted within each said gate cylinder, so as to extend and retract within said gate cylinder in the conventional manner of operation of hydraulic cylinders, the exposed end of each being pivotally mounted to one end of said hopper at a point whereon extension of said rod from said gate cylinder produces a 90° pivotation of said gate away from said bottom of said hopper.

* * * * *